US010139758B2

(12) United States Patent
Michishita

(10) Patent No.: US 10,139,758 B2
(45) Date of Patent: Nov. 27, 2018

(54) TRANSFER DEVICE ALLOWING SUPPRESSION OF OCCURRENCE OF SEPARATION DISCHARGE BETWEEN SHEETS, AND IMAGE FORMING APPARATUS

(71) Applicant: KYOCERA Document Solutions Inc., Osaka-shi, Osaka (JP)

(72) Inventor: Yasuhiro Michishita, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/718,299

(22) Filed: Sep. 28, 2017

(65) Prior Publication Data

US 2018/0107138 A1 Apr. 19, 2018

(30) Foreign Application Priority Data

Oct. 14, 2016 (JP) ..... 2016-202229

(51) Int. Cl.
*G03G 21/00* (2006.01)
*G03G 15/16* (2006.01)

(52) U.S. Cl.
CPC ..... *G03G 15/161* (2013.01)

(58) Field of Classification Search
USPC ..... 399/98, 99, 101, 121
See application file for complete search history.

(56) References Cited

U.S. PATENT DOCUMENTS 8,725,029 B2 * 5/2014 Fukuhara ..... G03G 15/161 399/101
9,366,999 B2 * 6/2016 Michishita ..... G03G 15/1665

FOREIGN PATENT DOCUMENTS

JP 2002031960 A 1/2002

* cited by examiner

*Primary Examiner* — Hoan Tran
(74) *Attorney, Agent, or Firm* — Alleman Hall Creasman & Tuttle LLP

(57) ABSTRACT

A transfer device includes a conveyance belt, a transfer roller, a stretch roller, and a cleaning member. The conveyance belt is configured to convey a sheet via a contact position with an image carrier. The transfer roller is configured to transfer the toner image onto the sheet at the contact position. The stretch roller is configured to stretch the conveyance belt at a separation position where the sheet is separated from the conveyance belt and the stretch roller is grounded via a resistance portion having electrical resistance. The cleaning member is provided to oppose the stretch roller across the conveyance belt, downstream, in a running direction of the conveyance belt, from the separation position, and is configured to attract the toner attached to a surface of the conveyance belt upon application of a voltage having a polarity opposite to the charge polarity of the toner.

6 Claims, 3 Drawing Sheets

FIG. 4

A10

| | STRUCTURE OF TRANSFER DEVICE 35 | | CLEANING PERFORMANCE | CONTAMINATION STATE OF COLLECTING MEMBER 36A | OCCURENCE OF DEFECTIVE IMAGE |
|---|---|---|---|---|---|
| | RESISTANCE PORTION 359 | GUIDE MEMBER 360 | | | |
| COMPARATIVE EXAMPLE | NONE | SURFACE RESISTIVITY $1\times10^{11}\Omega/cm^2$ | GOOD | POOR | YES |
| EXAMPLE 1 | RESISTOR (100 kΩ) | SURFACE RESISTIVITY $1\times10^{5}\Omega/cm^2$ | GOOD | POOR | YES |
| EXAMPLE 2 | RESISTOR (500 kΩ) | SURFACE RESISTIVITY $1\times10^{5}\Omega/cm^2$ | GOOD | GOOD | NO |
| EXAMPLE 3 | RESISTOR (1 MΩ) | SURFACE RESISTIVITY $1\times10^{5}\Omega/cm^2$ | GOOD | GOOD | NO |
| EXAMPLE 4 | RESISTOR (5 MΩ) | SURFACE RESISTIVITY $1\times10^{5}\Omega/cm^2$ | GOOD | GOOD | NO |
| EXAMPLE 5 | RESISTOR (10 MΩ) | SURFACE RESISTIVITY $1\times10^{5}\Omega/cm^2$ | POOR | GOOD | NO |
| EXAMPLE 6 | VARISTOR (VARISTOR VOLTAGE 250V) | SURFACE RESISTIVITY $1\times10^{5}\Omega/cm^2$ | GOOD | POOR | YES |
| EXAMPLE 7 | VARISTOR (VARISTOR VOLTAGE 500V) | SURFACE RESISTIVITY $1\times10^{5}\Omega/cm^2$ | GOOD | GOOD | NO |
| EXAMPLE 8 | VARISTOR (VARISTOR VOLTAGE 800V) | SURFACE RESISTIVITY $1\times10^{5}\Omega/cm^2$ | GOOD | GOOD | NO |
| EXAMPLE 9 | VARISTOR (VARISTOR VOLTAGE 1200V) | SURFACE RESISTIVITY $1\times10^{5}\Omega/cm^2$ | GOOD | GOOD | NO |
| EXAMPLE 10 | VARISTOR (VARISTOR VOLTAGE 1500V) | SURFACE RESISTIVITY $1\times10^{5}\Omega/cm^2$ | POOR | GOOD | NO |

TRANSFER DEVICE ALLOWING SUPPRESSION OF OCCURRENCE OF SEPARATION DISCHARGE BETWEEN SHEETS, AND IMAGE FORMING APPARATUS

INCORPORATION BY REFERENCE

This application is based upon and claims the benefit of priority from the corresponding Japanese Patent Application No. 2016-202229 filed on Oct. 14, 2016, the entire contents of which are incorporated herein by reference.

BACKGROUND

The present disclosure relates to an image forming apparatus capable of forming an image by electrophotography, and a transfer device mounted to the image forming apparatus.

An image forming apparatus, such as a printer, which is capable of forming an image by electrophotography includes a transfer device. For example, the transfer device includes a conveyance belt, a transfer roller, and a cleaning member. The conveyance belt causes a sheet such as a printing sheet to be electrostatically attracted thereto, and conveys the sheet via a contact position at which the sheet is in contact with an image carrier such as a photosensitive drum. The transfer roller transfers, onto the sheet, a toner image that is formed on the image carrier at the contact position. The cleaning member cleans a surface of the conveyance belt. For example, the cleaning member is provided to oppose a stretch roller that is disposed at a separation position where a sheet is separated from the conveyance belt, among a plurality of the stretch rollers which hold and stretch the conveyance belt between the stretch rollers. The stretch roller opposing the cleaning member is electrically grounded. In addition, a voltage having a polarity opposite to the charge polarity of toner is applied to the cleaning member. Thus, the toner attached to the surface of the conveyance belt is electrostatically attracted to the cleaning member.

SUMMARY

A transfer device according to an aspect of the present disclosure includes a conveyance belt, a transfer roller, a stretch roller, and a cleaning member. The conveyance belt is configured to convey a sheet via a contact position with an image carrier on which a toner image is formed. The transfer roller is provided to oppose the image carrier across the conveyance belt and is configured to transfer the toner image onto the sheet at the contact position upon application of a voltage having a polarity opposite to the charge polarity of toner that is included in the toner image formed on the image carrier. The stretch roller is configured to stretch the conveyance belt at a separation position where the sheet is separated from the conveyance belt and which separation position is provided downstream, in a running direction of the conveyance belt, from the contact position, and the stretch roller is grounded via a resistance portion having electrical resistance. The cleaning member is provided to oppose the stretch roller across the conveyance belt, downstream, in the running direction of the conveyance belt, from the separation position, and is configured to attract the toner attached to a surface of the conveyance belt upon application of a voltage having a polarity opposite to the charge polarity of the toner.

An image forming apparatus according to another aspect of the present disclosure includes the transfer device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 4 is a table indicating results of an experiment using the image forming apparatus according to the embodiment of the present disclosure.

DETAILED DESCRIPTION

Hereinafter, embodiments of the present disclosure will be described with reference to the accompanying drawings. The following embodiments each represent an exemplary implementation of the present disclosure and the technical scope of the present disclosure is not limited by the embodiments described below.

[Structure of Image Forming Apparatus 10]

First, a structure of an image forming apparatus 10 according to an embodiment of the present disclosure will be described with reference to FIG. 1. Here, FIG. 1 is a cross-sectional schematic diagram showing the structure of the image forming apparatus 10.

For convenience of explanation, the vertical direction in an installation state where the image forming apparatus 10 can be used (a state shown in FIG. 1) is defined as an up-down direction D1. A front-rear direction D2 is defined with, as a front face (front surface), a surface on the left side of the sheet surface of the image forming apparatus 10 shown in FIG. 1. A right-left direction D3 is defined on the basis of the front face of the image forming apparatus 10 in the installation state.

The image forming apparatus 10 is a multifunction peripheral having a scan function of reading image data from a document and a print function of forming an image on the basis of image data as well as a plurality of functions such as a facsimile function, a copy function, and the like. The present disclosure is applicable to image forming apparatuses such as a printer, a facsimile apparatus, and a copy machine.

Figure 1:
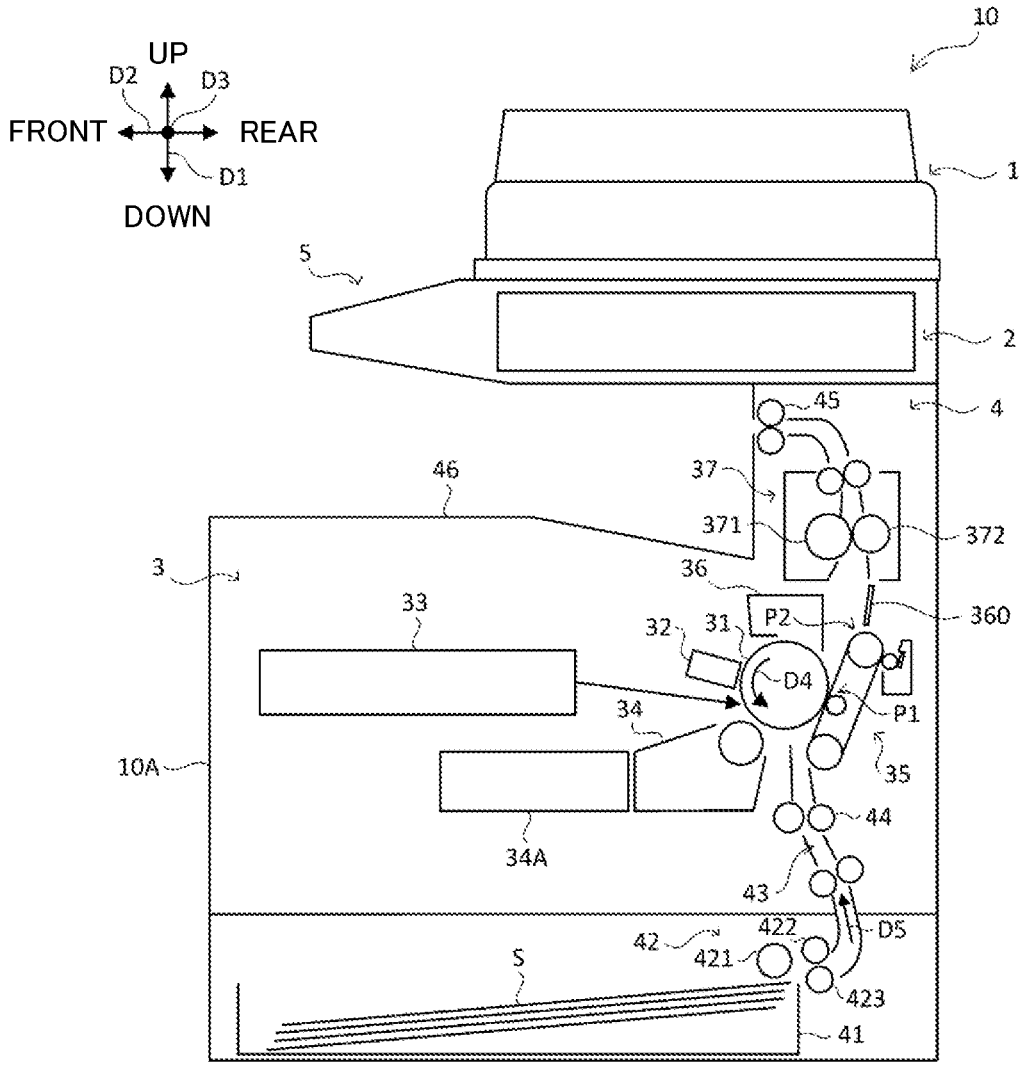
FIG. 1 is a diagram showing a structure of an image forming apparatus according to an embodiment of the present disclosure.

As shown in FIG. 1, the image forming apparatus 10 includes a housing 10A, an automatic document feeder (ADF) 1, an image reading portion 2, an image forming portion 3, a sheet conveying portion 4, and an operation display portion 5.

The housing 10A is formed in a substantially cuboid shape. As shown in FIG. 1, the housing 10A houses components including the image forming portion 3 and the sheet conveying portion 4. At an upper part of the housing 10A, the image reading portion 2 is provided. Above the image reading portion 2, the ADF 1 is provided. At a front end portion of the image reading portion 2, the operation display portion 5 is provided.

The ADF 1 includes a document set portion, a plurality of conveying rollers, a document holder, and a sheet discharge portion, and conveys a document to be read by the image reading portion 2. The image reading portion 2 includes a document table, a light source, a plurality of mirrors, an optical lens, and a CCD, and is capable of reading image data from the document. The operation display portion 5 includes: a display portion, such as a liquid crystal display, which displays various kinds of information in accordance with control instructions from a control portion (not shown); and an operation portion, such as an operation key or a touch panel, which allows input of various kinds of information to the control portion in accordance with operations by a user.

The image forming portion 3 is capable of forming an image by electrophotography on the basis of image data read by the image reading portion 2. In addition, the image forming portion 3 is also capable of forming an image on the basis of image data inputted from an external information processing apparatus such as a personal computer. Specifically, as shown in FIG. 1, the image forming portion 3 includes a photosensitive drum 31, a charging device 32, a laser scanning unit 33, a developing device 34, a transfer device 35, a cleaning device 36, and a fixing device 37.

An electrostatic latent image is formed on the surface of the photosensitive drum 31. As shown in FIG. 1, the photosensitive drum 31 is provided at a portion that is a side portion on the rear side of the housing 10A and that is around the central portion thereof in the up-down direction D1. The photosensitive drum 31 has a rotation shaft extending in the right-left direction D3. The rotation shaft is rotatably supported by an internal frame provided in the housing 10A. The photosensitive drum 31 rotates in a rotation direction D4 shown in FIG. 1 upon reception of a rotational driving force transmitted from a motor (not shown).

As shown in FIG. 1, around the photosensitive drum 31, the charging device 32, the laser scanning unit 33, the developing device 34, the transfer device 35, and the cleaning device 36 are provided along the rotation direction D4. The charging device 32 charges the surface of the photosensitive drum 31. The laser scanning unit 33 forms an electrostatic latent image on the surface of the photosensitive drum 31. The developing device 34 develops the electrostatic latent image formed on the surface of the photosensitive drum 31 by using toner. The transfer device 35 transfers a toner image formed on the photosensitive drum 31 onto a sheet S conveyed by the sheet conveying portion 4. The cleaning device 36 cleans the surface of the photosensitive drum 31 after the toner image is transferred by the transfer device 35.

As shown in FIG. 1, the fixing device 37 is provided above the photosensitive drum 31. The fixing device 37 causes the toner image transferred onto the sheet S by the transfer device 35 to be melted and fixed on the sheet S. Specifically, as shown in FIG. 1, the fixing device 37 includes a fixing roller 371 and a pressure roller 372. The fixing roller 371 is provided in contact with the pressure roller 372. The fixing roller 371 heats the toner image transferred onto the sheet S, thereby fixing the toner image on the sheet S. The pressure roller 372 adds pressure onto the sheet S that passes through a nip portion formed between the fixing roller 371 and the pressure roller 372.

The sheet conveying portion 4 supplies the sheet S to the image forming portion 3. Specifically, as shown in FIG. 1, the sheet conveying portion 4 includes a sheet feed cassette 41, a feeding mechanism 42, a conveyance path 43, a registration roller 44, a discharge roller 45, and a sheet discharge tray 46.

The sheet feed cassette 41 stores the sheet S on which an image is to be formed by the image forming portion 3. As shown in FIG. 1, the sheet feed cassette 41 is provided at a bottom portion of the housing 10A. For example, the sheet feed cassette 41 stores a sheet member such as paper, coated paper, a postcard, an envelope, or an OHP sheet.

The feeding mechanism 42 feeds the sheet S to the conveyance path 43. Specifically, as shown in FIG. 1, the feeding mechanism 42 includes a pickup roller 421, a feed roller 422, and a retard roller 423. The pickup roller 421 conveys, from the sheet feed cassette 41, the uppermost sheet S of a plurality of the sheets S stored in the sheet feed cassette 41. The feed roller 422 feeds, to the conveyance path 43, the sheet S conveyed from the sheet feed cassette 41 by the pickup roller 421. The retard roller 423 separates the uppermost sheet S from the other sheets S when the plural sheets S are conveyed from the sheet feed cassette 41 by the pickup roller 421.

The conveyance path 43 is a movement path, of the sheet S, which is formed between the sheet feed cassette 41 and the sheet discharge tray 46. For example, the conveyance path 43 is formed by a pair of conveyance guide members provided in the housing 10A. As shown in FIG. 1, the conveyance path 43 is provided at a side portion on the rear side of the housing 10A so as to extend in the up-down direction D1.

As shown in FIG. 1, the conveyance path 43 is provided with a plurality of rollers including the registration roller 44 and the discharge roller 45. The plurality of rollers are rotated on the basis of transmission of a driving force generated by a motor (not shown), so that the plurality of rollers convey the sheet S along the conveyance path 43 in a conveyance direction D5 as shown in FIG. 1. In addition, as shown in FIG. 1, the conveyance path 43 is provided with the photosensitive drum 31, the transfer device 35, and the fixing device 37. The sheet S conveyed along the conveyance path 43 is subjected to image formation by the image forming portion 3, and is discharged to the sheet discharge tray 46.

Here, a procedure for the image formation by the image forming portion 3 will be described. First, the surface of the photosensitive drum 31 is charged uniformly at a predetermined potential by the charging device 32. Next, the surface of the photosensitive drum 31 is irradiated with light based on image data by the laser scanning unit 33. Thus, the electrostatic latent image corresponding to the image data is formed on the surface of the photosensitive drum 31.

The electrostatic latent image formed on the surface of the photosensitive drum 31 is developed (visualized) as a toner image by the developing device 34. The toner image formed on the surface of the photosensitive drum 31 is conveyed to a transfer position P1 (see FIG. 1) of the transfer device 35, by the photosensitive drum 31 rotating in the rotation direction D4. Toner is supplied to the developing device 34 from a toner container 34A (see FIG. 1) detachably attached to the image forming portion 3. The photosensitive drum 31 is an exemplary image carrier in the present disclosure.

Meanwhile, the sheet conveying portion 4 conveys the sheet S to the transfer position P1 concurrently with an image forming operation by the image forming portion 3. Specifically, the sheet feed cassette 41 uses a lift plate (not shown) provided at the bottom portion of the sheet feed cassette 41 to lift up the sheet S stored in the sheet feed cassette 41 to a contact position at which the sheet S and the pickup roller 421 of the feeding mechanism 42 are in contact with each other. The feeding mechanism 42 feeds the sheet S lifted up by the lift plate to the conveyance path 43.

The registration roller 44 conveys the sheet S to the transfer position P1 at a timing when the toner image is conveyed to the transfer position P1 by the photosensitive drum 31. For example, the image forming apparatus 10 is provided with a sensor (not shown) which is capable of detecting passage of the sheet S and which is provided in the conveyance path 43 upstream from the registration roller 44 in the conveyance direction D5. In the image forming apparatus 10, a conveyance timing for the sheet S by the registration roller 44 is set on the basis of a detection timing for the passage of the sheet S by the sensor. Then, the registration roller 44 conveys the sheet S to the transfer position P1 on the basis of the conveyance timing that has been set. Thus, the toner image formed on the surface of the photosensitive drum 31 is transferred onto the surface of the sheet S, whereby an image is formed on the sheet S. The toner remaining on the surface of the photosensitive drum 31 is removed by the cleaning device 36.

The sheet S onto which the toner image has been transferred at the transfer position P1 is conveyed to the fixing device 37. In the fixing device 37, the toner image transferred onto the sheet S is heated by the fixing roller 371 and the pressure roller 372. Thus, the toner image is fixed on the sheet S. The sheet S on which the toner image is fixed in the fixing device 37 is discharged to the sheet discharge tray 46 by the discharge roller 45.

[Structure of Transfer Device 35]

Figure 2:
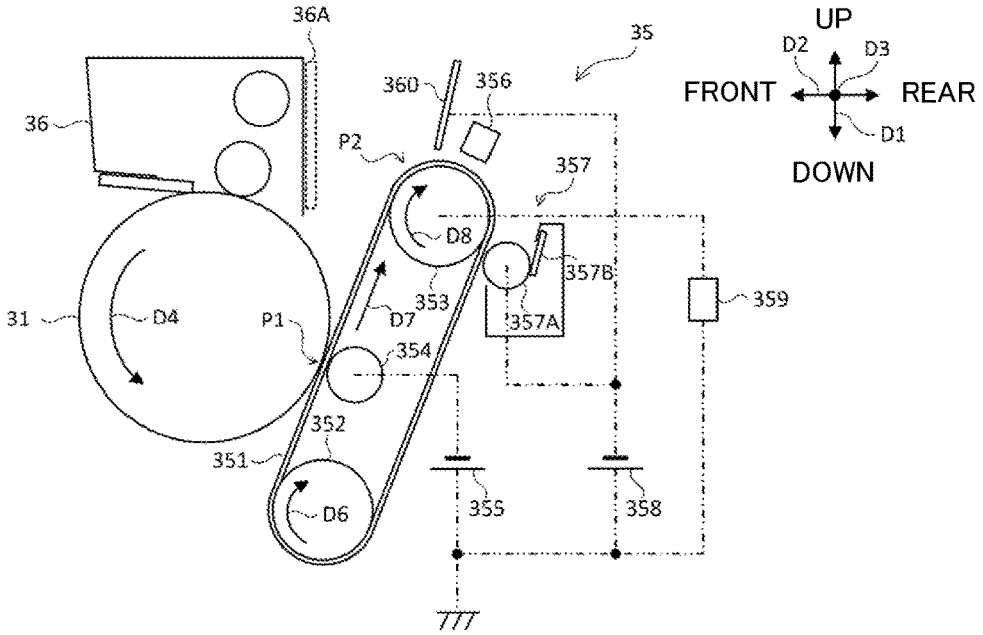
FIG. 2 is a diagram showing a structure of a transfer device in the image forming apparatus according to the embodiment of the present disclosure.
Figure 3:
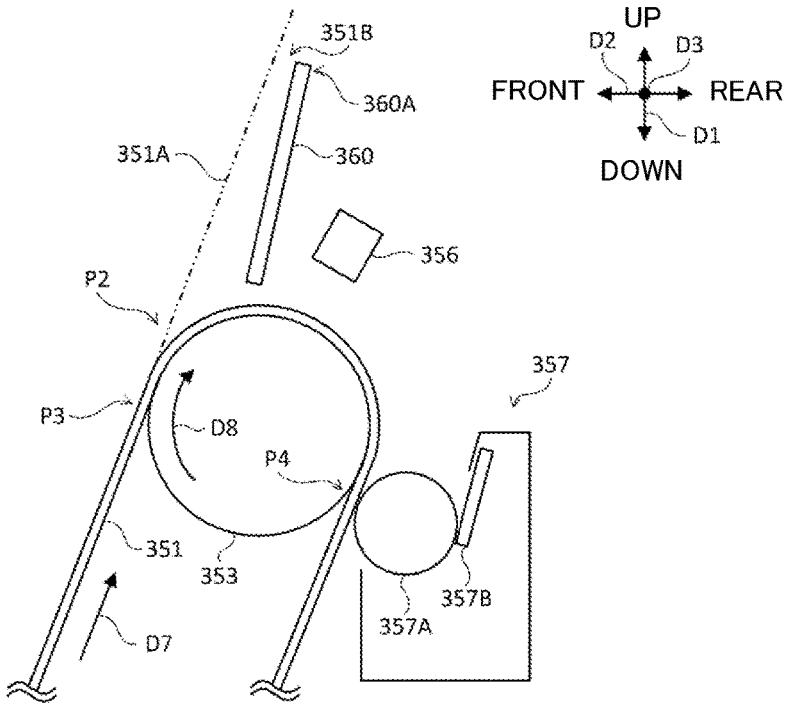
FIG. 3 is a diagram showing a structure around a second roller in the image forming apparatus according to the embodiment of the present disclosure.

Next, the transfer device 35 will be described in detail with reference to FIGS. 1 to 3. FIG. 2 is a cross-sectional schematic diagram showing the structure of the transfer device 35. FIG. 3 is a cross-sectional schematic diagram showing the structure around a second roller 353. In FIG. 2, a current conduction path of each component is shown with alternate long and two short dashes lines. In FIG. 3, a movement path 351A of the sheet S that has been separated from a conveyance belt 351 is shown with alternate long and two short dashes lines.

The transfer device 35 causes the sheet S conveyed from the registration roller 44 to be electrostatically attracted to the conveyance belt 351 so as to convey the sheet S, and transfers the toner image formed on the photosensitive drum 31 onto the sheet S at the transfer position P1. Specifically, as shown in FIG. 2, the transfer device 35 includes the conveyance belt 351, a first roller 352, the second roller 353, a transfer roller 354, a first voltage application portion 355, an optical sensor 356, a belt cleaning portion 357, a second voltage application portion 358, a resistance portion 359, and a guide member 360.

The conveyance belt 351 conveys the sheet S via the transfer position P1. As shown in FIG. 2, the conveyance belt 351 is a belt member, of endless type, which is stretched at a predetermined tension over the first roller 352 and the second roller 353. For example, the conveyance belt 351 is formed by coating an outer circumferential surface of a belt-shaped rubber member with fluorine-based resin such as PTFE.

As shown in FIG. 2, the conveyance belt 351 is provided in contact with the photosensitive drum 31. A contact position at which the photosensitive drum 31 and the conveyance belt 351 are in contact with each other is the transfer position P1 of a toner image transferred by the transfer device 35. The transfer position P1 is an exemplary contact position in the present disclosure.

As shown in FIG. 2, the first roller 352 and the second roller 353 are provided, in the up-down direction D1, separately from each other across the transfer position P1. The first roller 352 is disposed at a position below the transfer position P1 and stretches the conveyance belt 351. The second roller 353 is disposed at a position above the transfer position P1, and stretches the conveyance belt 351. The first roller 352 and the second roller 353 are formed of a conductive member such as metal.

The first roller 352 rotates in a rotation direction D6 shown in FIG. 2 by a rotational driving force transmitted from the motor (not shown). Thus, the conveyance belt 351 stretched by the first roller 352 and the second roller 353 runs along a running direction D7 shown in FIG. 2. In addition, the second roller 353 is rotated in a rotation direction D8, shown in FIG. 2, following the running of the conveyance belt 351. The second roller 353 may be driven to rotate by the motor, and the first roller 352 may be rotated, following the running of the conveyance belt 351.

The transfer roller 354 transfers the toner image formed on the photosensitive drum 31 at the transfer position P1, onto the sheet S, upon application of a voltage having a polarity opposite to the charge polarity of the toner that is included in the toner image formed on the photosensitive drum 31. As shown in FIG. 2, the transfer roller 354 is provided to oppose the photosensitive drum 31 across the conveyance belt 351.

For example, in the developing device 34 of the image forming apparatus 10, the toner is charged with positive polarity. In this case, a voltage of negative polarity is applied to the transfer roller 354. When a voltage of negative polarity is applied to the transfer roller 354, the toner image formed on the photosensitive drum 31 is attracted to the conveyance belt 351 side at the transfer position P1 due to a potential difference between the photosensitive drum 31 and the transfer roller 354. Thus, the toner image is transferred onto the sheet S conveyed via the transfer position P1. Electric charge of negative polarity is provided from the transfer roller 354 to the back surface of the conveyance belt 351. Then, the sheet S conveyed by the conveyance belt 351 is electrostatically attracted to the outer circumferential surface of the conveyance belt 351 due to the electric charge of negative polarity provided to the back surface of the conveyance belt 351.

The sheet S onto which the toner image has been transferred at the transfer position P1 is conveyed by the conveyance belt 351 from the transfer position P1 to the second roller 353 located downstream in the running direction D7, and is separated from the conveyance belt 351 due to self-stripping. The second roller 353 is an exemplary stretch roller in the present disclosure.

The first voltage application portion 355 applies a voltage having a polarity opposite to the charge polarity of the toner, to the transfer roller 354. The first voltage application portion 355 is a power supply electrically connected to the rotation shaft of the transfer roller 354. For example, the first voltage application portion 355 controls a voltage to be applied to the transfer roller 354 such that a constant current of −150 μA flows in the transfer roller 354.

The optical sensor 356 detects the density of the toner image transferred onto the outer circumferential surface of the conveyance belt 351 by the transfer roller 354. As shown in FIG. 2, the optical sensor 356 is provided, on the rear side of the guide member 360, to oppose the second roller 353 across the conveyance belt 351. On the basis of the detection result of the density of the toner image by the optical sensor 356, the image forming apparatus 10 performs a calibration process, in which values set for respective components of the image forming portion 3 are adjusted.

The belt cleaning portion 357 cleans the outer circumferential surface of the conveyance belt 351. As shown in FIG. 2, the belt cleaning portion 357 is provided downstream, in the running direction D7, from a separation position P2 where the sheet S is separated from the conveyance belt 351. Specifically, as shown in FIG. 2, the belt cleaning portion 357 includes a cleaning member 357A and a cleaning auxiliary member 357B.

The cleaning member 357A attracts the toner attached to the surface of the conveyance belt 351, upon application of a voltage having a polarity opposite to the charge polarity of the toner that is included in the toner image formed on the photosensitive drum 31. As shown in FIG. 2, the cleaning member 357A is provided to oppose the second roller 353 across the conveyance belt 351. For example, the cleaning member 357A is a roller formed of a conductive member such as metal. The cleaning member 357A may be a fur brush formed of a material having conductivity.

As described above, in the developing device 34 of the image forming apparatus 10, the toner is charged with positive polarity. In this case, a voltage of negative polarity is applied to the cleaning member 357A. When a voltage of negative polarity is applied to the cleaning member 357A, the toner attached to the surface of the conveyance belt 351 is attracted to the surface of the cleaning member 357A due to a potential difference between the cleaning member 357A and the second roller 353. Thus, the toner is removed from the surface of the conveyance belt 351.

The cleaning auxiliary member 357B removes the toner attached to the surface of the cleaning member 357A. For example, the cleaning auxiliary member 357B is a blade made of rubber and provided in contact with the surface of the cleaning member 357A. The toner removed from the surface of the cleaning member 357A by the cleaning auxiliary member 357B is conveyed to a toner receiving container (not shown) and collected therein. When the cleaning member 357A is a fur brush, the cleaning auxiliary member 357B may be a scraper made of metal and provided in contact with the surface of the cleaning member 357A.

The second voltage application portion 358 applies a voltage having a polarity opposite to the charge polarity of the toner, to the cleaning member 357A. The second voltage application portion 358 is a power supply electrically connected to the rotation shaft of the cleaning member 357A. For example, the second voltage application portion 358 controls a voltage to be applied to the cleaning member 357A such that a constant current of −20 μA flows in the cleaning member 357A.

Incidentally, when the second roller 353 disposed at the separation position P2 is electrically grounded, the electric charge of negative polarity provided to the back surface of the conveyance belt 351 by the transfer roller 354 flows out to the ground due to contact between the conveyance belt 351 and the second roller 353. In this case, a potential difference between the sheet S and the conveyance belt 351 may be increased, and separation discharge may occur between the sheet S and the conveyance belt 351 when the sheet S is separated from the conveyance belt 351. When separation discharge occurs between the sheet S and the conveyance belt 351, the sheet S discharges the electric charge of negative polarity toward the conveyance belt 351 and is charged with positive polarity, while the conveyance belt 351 is charged with negative polarity. The charge polarities of the sheet S and the conveyance belt 351 due to separation discharge are determined in accordance with a positional relationship between the material of the sheet S and the material of the conveyance belt 351 in the known triboelectric series.

When the sheet S is charged with positive polarity due to separation discharge, electrostatic Coulomb force applied between the sheet S and the toner that is included in the toner image transferred onto the sheet S may be decreased and the toner may be scattered from the sheet S. Meanwhile, when a voltage having a polarity opposite to the charge polarity of the toner is applied to the second roller 353 disposed at the separation position P2, it is possible to suppress separation discharge that occurs between the sheet S and the conveyance belt 351.

However, when a voltage having a polarity opposite to the charge polarity of the toner is applied to the second roller 353 disposed at the separation position P2, a potential difference between the second roller 353 and the cleaning member 357A provided to oppose the second roller 353 is decreased. Thus, a force by the cleaning member 357A to attract the toner attached to the surface of the conveyance belt 351 is decreased. That is, the cleaning performance of the cleaning member 357A is decreased. Meanwhile, when a voltage to be applied to the cleaning member 357A is increased, a decrease in the cleaning performance of the cleaning member 357A may be avoided. However, in this case, power consumed by the transfer device 35 is increased.

Meanwhile, in the image forming apparatus 10 according to the embodiment of the present disclosure, as described below, it is possible to suppress separation discharge that occurs between the sheet S and the conveyance belt 351, without increasing power consumption.

Specifically, in the image forming apparatus 10, as shown in FIG. 2, the second roller 353 is electrically grounded via the resistance portion 359 having electrical resistance. For example, the resistance portion 359 is a resistor.

The electric charge of negative polarity that is provided from the transfer roller 354 and that is accumulated on the back surface of the conveyance belt 351 flows out to the ground while the conveyance belt 351 is in contact with the second roller 353. Here, an amount of electric charge flowing out from the conveyance belt 351 is affected by the magnitude of resistance component in a current conduction path between the conveyance belt 351 and the ground. Specifically, as the resistance component is greater, an outflow of the electric charge from the conveyance belt 351 is suppressed.

Thus, in the image forming apparatus 10, the resistance portion 359 is provided so as to increase the resistance component. Thus, an outflow of the electric charge from the conveyance belt 351 to the ground is suppressed as compared to a structure in which the resistance portion 359 is not provided. Thus, an amount of the electric charge flowing out from the conveyance belt 351, during the conveyance belt 351 running to the separation position P2 from a contact position P3 (see FIG. 3) at which the conveyance belt 351 is in contact with the second roller 353, is decreased. Thus, increase in the potential difference between the sheet S and the conveyance belt 351 at the separation position P2 is suppressed and separation discharge between the sheet S and the conveyance belt 351 is suppressed.

When electrical resistance of the resistance portion 359 is excessively low, an amount of the electric charge flowing out from the conveyance belt 351 during the conveyance belt 351 running to the separation position P2 from the contact position P3 is increased, so that it is difficult to suppress separation discharge. Meanwhile, when electrical resistance of the resistance portion 359 is excessively high, an amount of the electric charge flowing out from the conveyance belt 351 during the conveyance belt 351 running from the contact position P3 to a cleaning position P4 (see FIG. 3) of the cleaning member 357A is decreased, so that the cleaning performance of the cleaning member 357A is decreased. Thus, it is desirable that the electrical resistance of the resistance portion 359 is set to an appropriate value. Specifically, it is desirable that the electrical resistance of the resistance portion 359 is set in a range of not less than 500 kΩ and not more than 5 MΩ.

The resistance portion 359 may be a varistor. In this case, it is desirable that a varistor voltage of the resistance portion 359 is set in a range of not less than 500 V and not more than 1200 V. Alternatively, the resistance portion 359 may be a Zener diode.

As shown in FIG. 1, the guide member 360 is provided between the separation position P2 and the fixing device 37, and guides the conveyance of the sheet S from the separation position P2 to the fixing device 37. As shown in FIGS. 2 and 3, the guide member 360 is provided to oppose a contact surface of the sheet S conveyed from the separation position P2 to the fixing device 37, the contact surface being in contact which the conveyance belt 351. The guide member 360 is formed of a conductor.

In the image forming apparatus 10, the guide member 360 is disposed in a predetermined orientation with respect to the movement path 351A (see FIG. 3) of the sheet S, and thus, separation motion of the sheet S that is separated from the conveyance belt 351 due to self-stripping is supported. For example, the guide member 360 is disposed such that an angle formed by a straight line extending from the axis of the second roller 353 to a point of contact of the second roller 353 in the movement path 351A and a straight line extending from the axis of the second roller 353 toward a rear end portion, in the conveyance direction D5 (see FIG. 1), of the guide member 360 is in a range of not less than 30 degrees and not more than 60 degrees.

In the image forming apparatus 10, a voltage having a polarity opposite to the charge polarity of the toner that is included in the toner image formed on the photosensitive drum 31 is applied to the guide member 360. Specifically, as shown in FIG. 2, the guide member 360 is electrically connected to the second voltage application portion 358. The second voltage application portion 358 applies a voltage having a polarity opposite to the charge polarity of the toner to the guide member 360, in addition to the cleaning member 357A. The second voltage application portion 358 is an exemplary voltage application portion in the present disclosure.

Thus, discharge is caused to occur between the guide member 360 and the sheet S conveyed, along the movement path 351A (see FIG. 3), from the second roller 353 toward the fixing device 37, and thereby it is possible to provide the electric charge of negative polarity to the sheet S. Since the electric charge of negative polarity is provided to the sheet S, it is possible to avoid the occurrence of a phenomenon called electrostatic offset in which the toner on the sheet S is not fixed on the sheet S in the fixing device 37 but is electrostatically attached to the fixing roller 371, so that a defective image occurs on the following sheet S.

In addition, the guide member 360 is provided, via a gap 351B having a predetermined width, between a leading end portion 360A (see FIG. 3) of the guide member 360 and the movement path 351A of the sheet S. Here, the width of the gap 351B is set as appropriate on the basis of the known Paschen's law such that discharge occurs between the sheet S and the leading end portion 360A of the guide member 360. For example, in the image forming apparatus 10, the gap 351B is set to 1 mm.

The guide member 360 may have a voltage applied from a power source different from the second voltage application portion 358. The guide member 360 may be provided to oppose a contact surface of the sheet S conveyed from the separation position P2 to the fixing device 37, the contact surface being in contact with the photosensitive drum 31. In the image forming apparatus 10, a structure in which a voltage is not applied to the guide member 360 is possible as another embodiment.

Examples 1 to 5

In the image forming apparatus 10, an experiment was conducted to study the cleaning performance of the cleaning member 357A, a scattering state of toner at the separation position P2, and an occurrence state of a defective image by using a resistor as the resistance portion 359 and varying a resistance value of the resistance portion 359. Results of the experiment are indicated in FIG. 4.

In the experiment, the cleaning performance of the cleaning member 357A was studied in accordance with a method in which the image forming apparatus 10 is caused to execute, 10,000 times, a printing process of printing experimental image data having a printing rate of 50% and the state of the conveyance belt 351 after the 10,000 times of the printing process is checked. In FIG. 4, "GOOD" represents that attachment of the conveyance belt 351 was not confirmed. In FIG. 4, "POOR" represents that attachment of the toner to the conveyance belt 351 was confirmed and the attachment amount of the toner surpassed the upper limit of a predetermined allowable range.

In addition, in the experiment, the scattering state of the toner was studied in accordance with a method in which a collecting member 36A (see FIG. 2) is provided at an outer side surface, of the cleaning device 36, which opposes the separation position P2, and a contamination state of the collecting member 36A after the 10,000 times of the printing process is checked. In FIG. 4, "GOOD" represents that contamination of the collecting member 36A by the toner was not confirmed. In FIG. 4, "POOR" represents that contamination of the collecting member 36A by the toner was confirmed and the level of contamination surpassed a predetermined allowable range.

In the experiment, the occurrence state of a defective image was studied in accordance with a method in which it is confirmed whether or not a defective image occurred in the 10,000 times of the printing process.

In addition, at the time of the experiment, the specification of the image forming apparatus 10 was as follows.

Printing speed: 80 ppm (page/minute)

Conveyance belt 351: volume resistivity of $1\times10^{10}$ Ω·cm, surface resistivity of $1\times10^{11}$ Ω/cm$^2$, thickness of 500 μm, inner diameter of 50 mm Coating material of conveyance belt 351: PTFE, average coating thickness of 7 μm Resistance value of transfer roller 354: $1\times10^5$Ω

Current flowing in transfer roller 354: constant current of −150 μA

Current flowing in cleaning member 357A: constant current of −20 μA

Cleaning member 357A: fur brush shape, outer diameter of 15 mm, rotation at speed 1.2 times faster than speed in trail direction with respect to running direction D7 of conveyance belt 351, amount of cutting into conveyance belt 351 being 0.75 mm Cleaning auxiliary member 357B: scraper shape, made of SUS, thickness of 0.2 mm, amount of cutting into cleaning member 357A being 0.5 mm Comparative Example In the image forming apparatus 10, an experiment similar to that as described above was conducted by removing the resistance portion 359. Results of the experiment are indicated in FIG. 4.

Examples 6 to 10

In the image forming apparatus 10, an experiment similar to that as described above was conducted by using a varistor as the resistance portion 359 and varying the varistor voltage of the resistance portion 359. Results of the experiment are indicated in FIG. 4. The cleaning member 357A and the cleaning auxiliary member 357B used are as follows.

Cleaning member 357A: roller shape, three-arrow-shaped tube made of aluminum, alumite processing on surface layer, outer diameter of 12 mm, rotation at speed 1.2 times faster than speed in trail direction with respect to running direction D7 of conveyance belt 351, gap with conveyance belt 351 being 0.0 mm Cleaning auxiliary member 357B: blade shape, made of urethane rubber, thickness of 1.2 mm, amount of cutting into cleaning member 357A being 0.75 mm, contact angle with respect to cleaning member 357A being 18 degrees According to an experimental result A10 indicated in FIG. 4, in a case where the resistance value was not less than 500 kΩ (Examples 2 to 5), among cases where a resistor was used as the resistance portion 359 (Examples 1 to 5), the scattering of toner at the separation position P2 was suppressed. The reason is thought to be that since the outflow of the electric charge from the conveyance belt 351 during the conveyance belt 351 running from the contact position P3 (see FIG. 3) to the separation position P2 was suppressed by the resistance portion 359, the occurrence of separation discharge was suppressed.

According to the experimental result A10 indicated in FIG. 4, in a case where the resistance value was 100 kΩ (Example 1), among cases where a resistor was used as the resistance portion 359 (Examples 1 to 5), the scattering of toner at the separation position P2 was not suppressed. The reason is thought to be that the outflow of the electric charge from the conveyance belt 351 during the conveyance belt 351 running from the contact position P3 (see FIG. 3) to the separation position P2 was not sufficiently suppressed by the resistance portion 359, the occurrence of separation discharge was not suppressed.

According to the experimental result A10 indicated in FIG. 4, in a case where the resistance value was 10 MΩ (Example 5), among cases where a resistor was used as the resistance portion 359 (Examples 1 to 5), the cleaning performance of the cleaning member 357A was decreased. The reason is thought to be that since the outflow of the electric charge from the conveyance belt 351 during the conveyance belt 351 running from the contact position P3 (see FIG. 3) to the cleaning position P4 was excessively suppressed by the resistance portion 359, a potential difference between the cleaning member 357A and the conveyance belt 351 was not increased.

According to the experimental result A10 indicated in FIG. 4, it has been confirmed that even in a case where a varistor was used as the resistance portion 359 (Examples 6 to 10), the same advantageous effects as those obtained when a resistor was used as resistance portion 359 (Examples 1 to 5) are obtained.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A transfer device comprising:

a conveyance belt configured to convey a sheet via a contact position with an image carrier on which a toner image is formed;

a transfer roller being provided to oppose the image carrier across the conveyance belt, the transfer roller being configured to transfer the toner image onto the sheet at the contact position upon application of a voltage having a polarity opposite to a charge polarity of toner that is included in the toner image formed on the image carrier;

a stretch roller configured to stretch the conveyance belt at a separation position where the sheet is separated from the conveyance belt and which separation position is provided downstream, in a running direction of the conveyance belt, from the contact position, the stretch roller being grounded via a resistance portion having electrical resistance; and a cleaning member being provided to oppose the stretch roller across the conveyance belt, downstream, in the running direction of the conveyance belt, from the separation position, the cleaning member being configured to attract the toner attached to a surface of the conveyance belt upon application of a voltage having a polarity opposite to the charge polarity of the toner.

2. The transfer device according to claim 1, further comprising a guide member being provided between the separation position and a fixing device that fixes the toner image on the sheet, the guide member being configured to guide conveyance of the sheet from the separation position to the fixing device, the guide member having applied thereto a voltage having a polarity opposite to the charge polarity of the toner.

3. The transfer device according to claim 2, wherein the guide member is provided to oppose a contact surface of the sheet conveyed from the separation position to the fixing device, the contact surface being in contact with the conveyance belt.

4. The transfer device according to claim 2, further comprising a voltage application portion configured to apply, to the cleaning member and the guide member, a voltage having a polarity opposite to the charge polarity of the toner.

5. The transfer device according to claim 1, wherein the resistance portion is a resistor or a varistor.

6. An image forming apparatus comprising the transfer device according to claim 1.

* * * * *